US009881443B2

(12) United States Patent
Maher et al.

(10) Patent No.: US 9,881,443 B2
(45) Date of Patent: Jan. 30, 2018

(54) FLOATING PIVOT POINT HINGE FOR A WAGERING GAME CABINET DOOR

(71) Applicant: Bally Gaming, Inc., Las Vegas, NV (US)

(72) Inventors: Stephen J. Maher, Grotton Saddleworth (GB); Michael Corristine, Bolton (GB); Gregory E. Klostermann, Arlington Heights, IL (US); Andrew Lloyd, Bury (GB)

(73) Assignee: Bally Gaming, Inc., Las Vegas, NV (US)

( * ) Notice: Subject to any disclaimer, the term of this patent is extended or adjusted under 35 U.S.C. 154(b) by 266 days.

(21) Appl. No.: 14/717,298

(22) Filed: May 20, 2015

(65) Prior Publication Data

US 2016/0343204 A1 Nov. 24, 2016

(51) Int. Cl.

| | |
|---|---|
| ***A63F 9/24*** | (2006.01) |
| ***G07F 17/32*** | (2006.01) |
| ***E05D 3/02*** | (2006.01) |
| ***E05F 3/02*** | (2006.01) |
| ***E05F 1/10*** | (2006.01) |
| ***E05F 1/12*** | (2006.01) |
| *E05D 5/06* | (2006.01) |

(52) U.S. Cl.

CPC ..... *G07F 17/3216* (2013.01); *E05D 3/022* (2013.01); *E05F 1/1091* (2013.01); *E05F 1/1292* (2013.01); *E05F 3/02* (2013.01); *E05D 2005/067* (2013.01); *E05Y 2201/416* (2013.01); *E05Y 2900/60* (2013.01); *E05Y 2900/608* (2013.01)

(58) Field of Classification Search

None

See application file for complete search history.

(56) References Cited

U.S. PATENT DOCUMENTS

| | | | | |
|---|---|---|---|---|
| 5,810,460 | A * | 9/1998 | Hansen | A47F 3/007 16/277 |
| 6,050,446 | A * | 4/2000 | Lei | H01L 21/67017 220/264 |
| 6,474,758 | B1 | 11/2002 | Hedrick et al. | 312/223.1 |
| 7,806,770 | B2 | 10/2010 | Nystrom | 463/46 |
| 8,201,306 | B2 | 6/2012 | Kim | 16/360 |
| 8,250,706 | B2 | 8/2012 | Vanini | 16/286 |

(Continued)

*Primary Examiner* — Lawrence Galka

(74) *Attorney, Agent, or Firm* — David J. Bremer

(57) ABSTRACT

A gaming system includes a housing having gaming components therein. The housing has a door opening and a door capable of rotating about a hinge axis defined by a set of hinge pins rigidly affixed to the housing. Attached to the door are a set of hinge arms having a set of specially shaped hinge slots positioned around the hinge pins. The hinge arms are additionally coupled to the housing by a set of spring components. When the housing door is not in a closed position, the spring components bias the door to an open position. When the housing door is in the closed position, the spring components bias the door in a direction defined by the hinge slots such that the door remains in a neutral position minimizing a spacing gap along one edge of the door. A set of roller guides align the door with a set of corresponding roller pins when the door approaches the closed position, and a locking mechanism is configured to latch the door to the housing in the closed position.

20 Claims, 11 Drawing Sheets

(56) References Cited

U.S. PATENT DOCUMENTS

| | | | | |
|---|---|---|---|---|
| 8,616,982 | B2 | 12/2013 | Greenberg et al. | 463/46 |
| 8,641,534 | B2 | 2/2014 | Hashimoto | 463/46 |
| 8,851,989 | B2 | 10/2014 | Rosander et al. | 463/31 |
| 8,938,185 | B1 | 1/2015 | Spitz | 399/110 |
| 2013/0023346 | A1 | 1/2013 | Greenberg et al. | 463/46 |
| 2014/0087868 | A1 | 3/2014 | Rosander et al. | 463/31 |

* cited by examiner

FLOATING PIVOT POINT HINGE FOR A WAGERING GAME CABINET DOOR

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to a hinge mechanism for a door used in an electronic wagering game machine housing.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

The aesthetics of gaming machines are also important for attracting players and improving the overall appearance of machines. Further, there is also a continued need for easing access to internal components of gaming machines to expedite the process of maintenance and troubleshooting. Therefore, there is a continuing need for improving gaming machines to be visually appealing, in addition to providing features making the machines easy to maintain using components that maintain structural integrity.

SUMMARY OF THE INVENTION

According to one aspect of the present invention, a gaming terminal comprises a housing for enclosing gaming components, a door opening in the housing for accessing the gaming components inside the game housing, a door connected to the housing, a pair of hinge arms, a pair of closure components, and a pair of mating door guides and door stops. The door has an open position that exposes the door opening and a closed position that covers the door opening. Each hinge arm has a first end and a second end, the first end being fixed to the door and the second end being movably connected to the housing by a hinge pin engaging a hinge slot in the hinge arm enabling the hinge arm to both translate and rotate about the hinge pin. The hinge pin is connected to one of the second end of the hinge arm and the housing and the hinge slot is part of the other of the second end of the hinge arm and the housing. The closure components are each pivotally connected to one of the pair of hinge arms between the first end and the second end. Each closure component applies an upwards force on the corresponding hinge arm as the door translates between the open and the closed position. The closure components support the hinge arms while the door in the open position is cantilevered from the opposite ends of the hinge arms by restraining the hinge pins against one end of the hinge slots. Each door guide is fixed to one of the door and the housing, and each corresponding door stop is fixed to the other of the door and the housing. The pair of mating door guides and door stops restrains the door while the door is supported by the closure components in the closed position.

According to one aspect of the present invention, a gaming terminal comprises a housing, a door assembly, and mating door-positioning connectors. The housing encloses internal gaming components and includes a door opening for accessing the gaming components. The door assembly has an open position that exposes the door opening and a closed position that covers the door opening. The door assembly includes a door, a hinge arm having a first end and a second end, a closure component pivotally connected to the hinge arm between the first and second end. The first end of the hinge arm is fixed to the door and the second end is movably connected to the housing by a hinge pin that engages a hinge slot. The hinge pin is connected to one of the second end and the housing, the hinge slot being part of the other of the second end and the housing. The closure component applies an upward force to the hinge arm (toward the hinge pin) while the door assembly moves between the open and closed positions. The mating door-positioning connectors include a door guide and a door stop. When the door is in the closed position, the mating door-positioning connectors (and the location of the hinge pins and hinge slots) fix the door position. The door guide is fixed to one of the door assembly and the housing and the door stop is fixed to the other one of the door assembly and the housing. The door-positioning connectors engage when the door assembly is proximate the closed position and resisting the upward force when the door assembly is positioned in the closed position. The door assembly in the open position is supported by the upward force of the closure components, and is restrained by the hinge pin being seated at one end of the hinge slot. The door assembly in the closed position is supported by the upward force of the closure components and restrained by the door guide engaging the door stop. The hinge pin is positioned medial the one end and an opposite end of the hinge slot when the door assembly is in the closed position.

According to one aspect of the present invention, a gaming system comprises a housing, a door assembly, and a pair of mating door-positioning connectors. The gaming system may be incorporated into a single, freestanding gaming machine. The housing encloses gaming components internal to the gaming system and includes a door opening for accessing the gaming components. The door assembly has an open position that exposes the door opening and a closed position that covers the door opening. The door assembly includes a door, a pair of hinge arms, and a pair of closure components. Each hinge arm has a first end and a second end, the first end being fixed to the door and the second end being movably connected to the housing by a hinge pin. The hinge pin engages a corresponding hinge slot enabling the hinge arm to both translate and rotate about the hinge pin. The hinge pin is connected to the housing and the hinge slot is part of the second end of the hinge arm. The closure components are each pivotally connected to one of the pair of hinge arms between the door and the second end. Each closure component applies a translational force on the corresponding hinge arm (toward the corresponding hinge pin) while the door moves between the open and the closed position. The pair of mating door-positioning connectors each includes a door guide and a door stop. The door guide is fixed to the door assembly and the door stop is fixed to the housing. The mating door-positioning connectors fix the door position in the closed position by engaging when the door assembly is proximate the closed position by resisting the translational force when the door assembly is in the closed position. The door assembly in the open position is held static by the translational force and is actively restrained by the hinge pins (being seated at one end of the hinge slots). The door assembly in the closed position is held static by the translational force and restrained by the door guides engaging the door stops. When the door assembly is in the closed position, the hinge pins are positioned medial the one end and an opposite end of the hinge slots.

Additional aspects of the invention will be apparent to those of ordinary skill in the art in view of the detailed description of various embodiments, which is made with reference to the drawings, a brief description of which is provided below.

Figure 1:
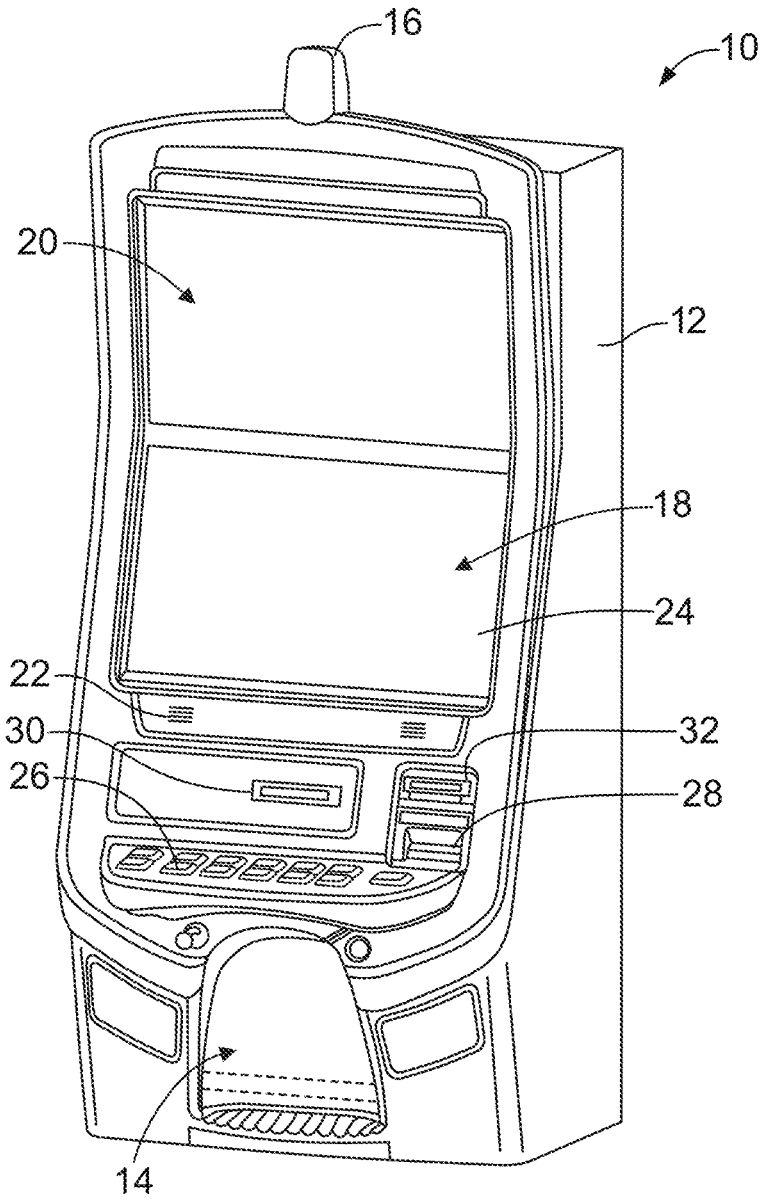
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

In one embodiment, the present invention relates to a cabinet door hinge having an elongated mounting hole such that a changing center of rotation throughout the door travel is achieved as the mounting hinge pin moves inside the hole. The floating pivot point, in conjunction with a fixed roller in the cabinet and a fixed guide on the cabinet door, allows the cabinet door to close in the same location on any cabinet and achieve consistent positioning of the cabinet door and surrounding seams. Variances in tolerance between hinge mounting location, hinge size, door size, roller location, and guide location is taken up by the elongated hole in the hinge.

In one embodiment, the floating hinge design removes forces on components that may become compressed, flexed, or stressed in damaging ways. Due to the shape of the hinge construction and the force of a specifically positioned door-opening gas strut, the floating hinge reduces stress caused as a result of location of the door location roller and the hinge rotation point. In a configuration having multiple non-floating hinges aligned along a common rotational axis, as the door is closed and the fixed hinge-rotation positions are not precisely matched, the hinge must flex to accommodate the changes in distance of the movement of the hinge; the increased pressure applied to the statically-located hinges and aligning door rollers will cause jamming and/or bending of components. Using an elongated hole in the floating hinges enables self-adjustment during rotation as the cabinet door closes, guided by the door rollers and roller guides. Further, when the door is in the closed position, the geometry of the gas struts bias the door to a specific neutral position rather than applying forces for opening or closing the door. The assembly of components of the gaming cabinet provides enhanced accuracy in door positioning when tolerances are not strictly met during component manufacturing and reduces overall stress to the door and cabinet components. Thus, consistent door closure and consistent seams between door and cabinet may be maintained from cabinet to cabinet. This results in a higher quality appearance of each of the cabinets, better customer satisfaction, and the elimination of costly and expensive rework time during manufacturing.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. No. 6,517,433, U.S. Pat. No. 8,057,303, and U.S. Pat. No. 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. The value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
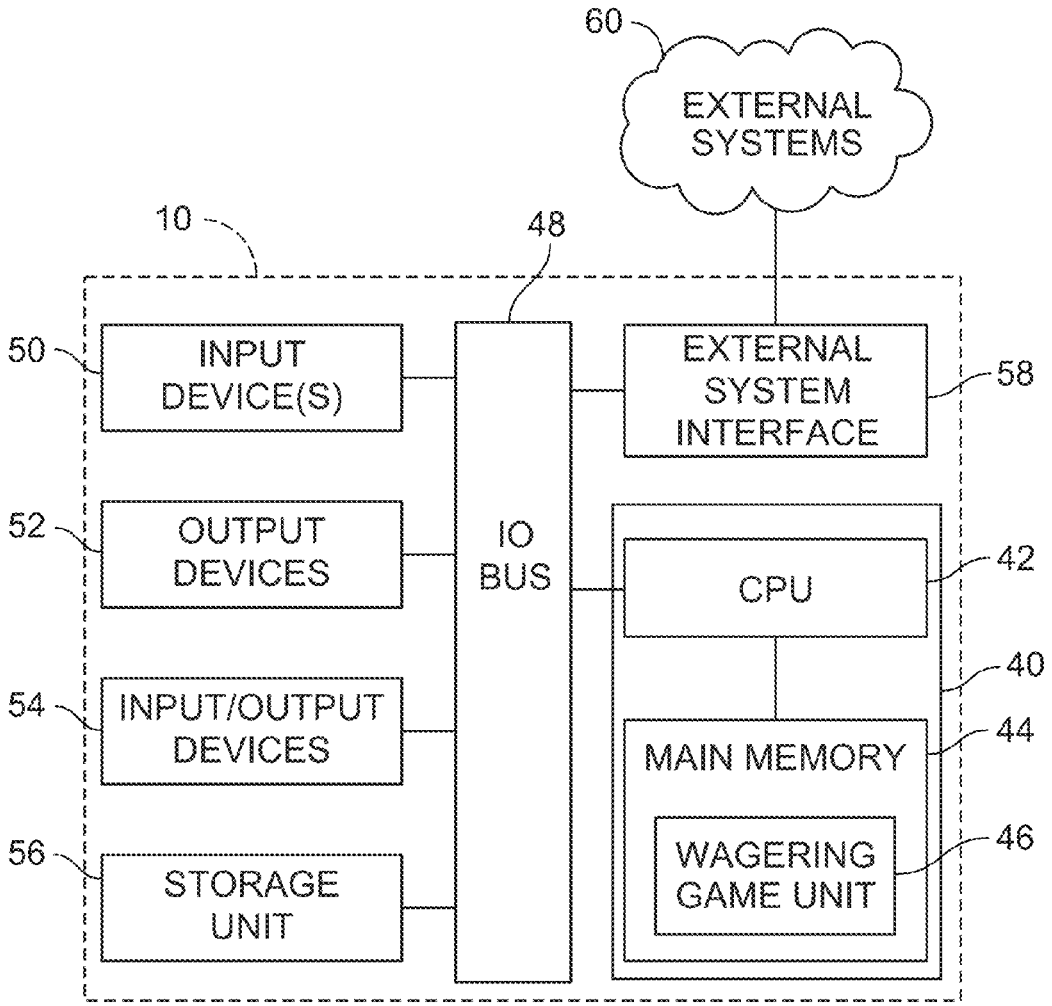
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compares it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
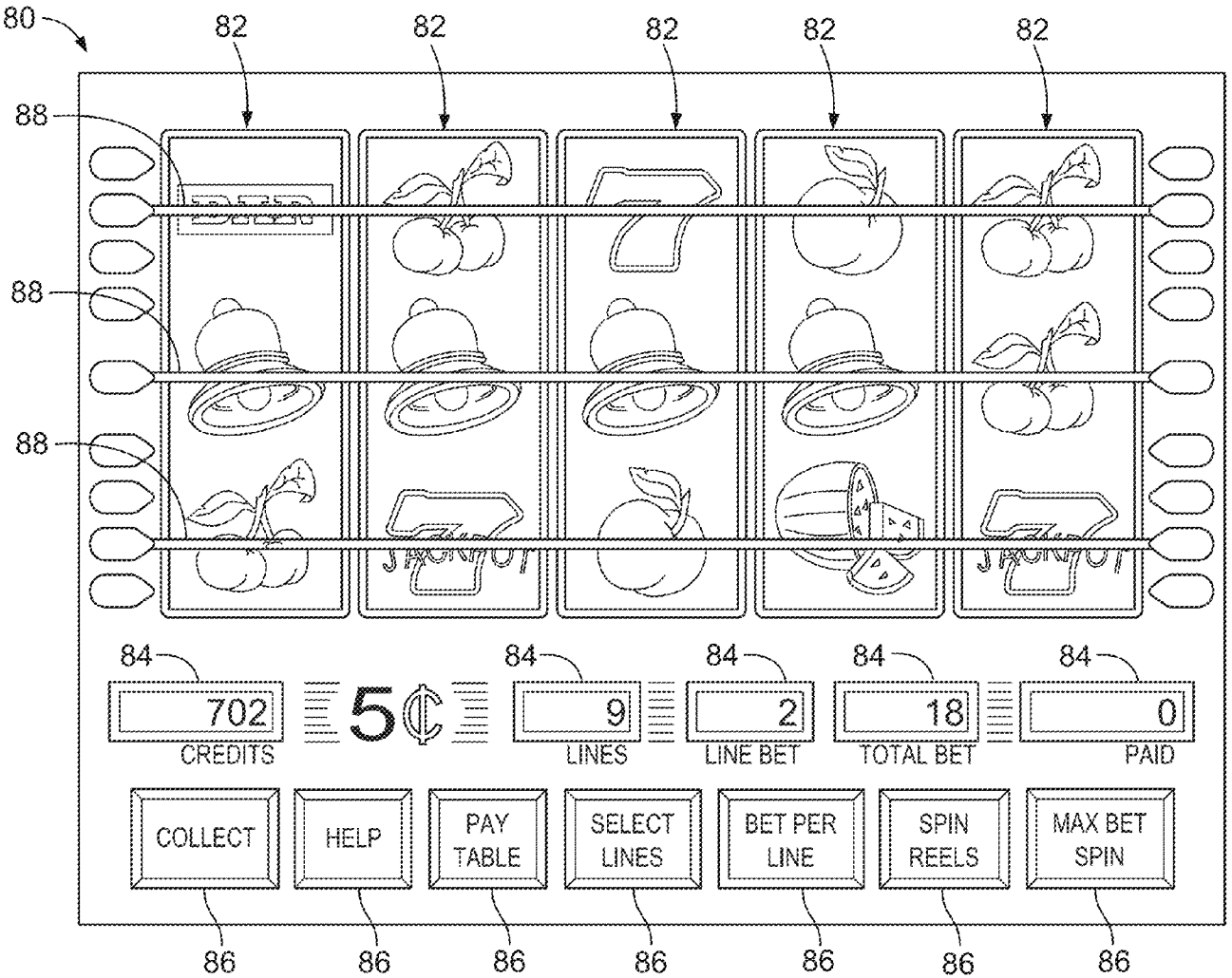
FIG. 3 is an image of an exemplary basic-game screen of a wagering game displayed on a gaming machine, according to an embodiment of the present invention.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4A:
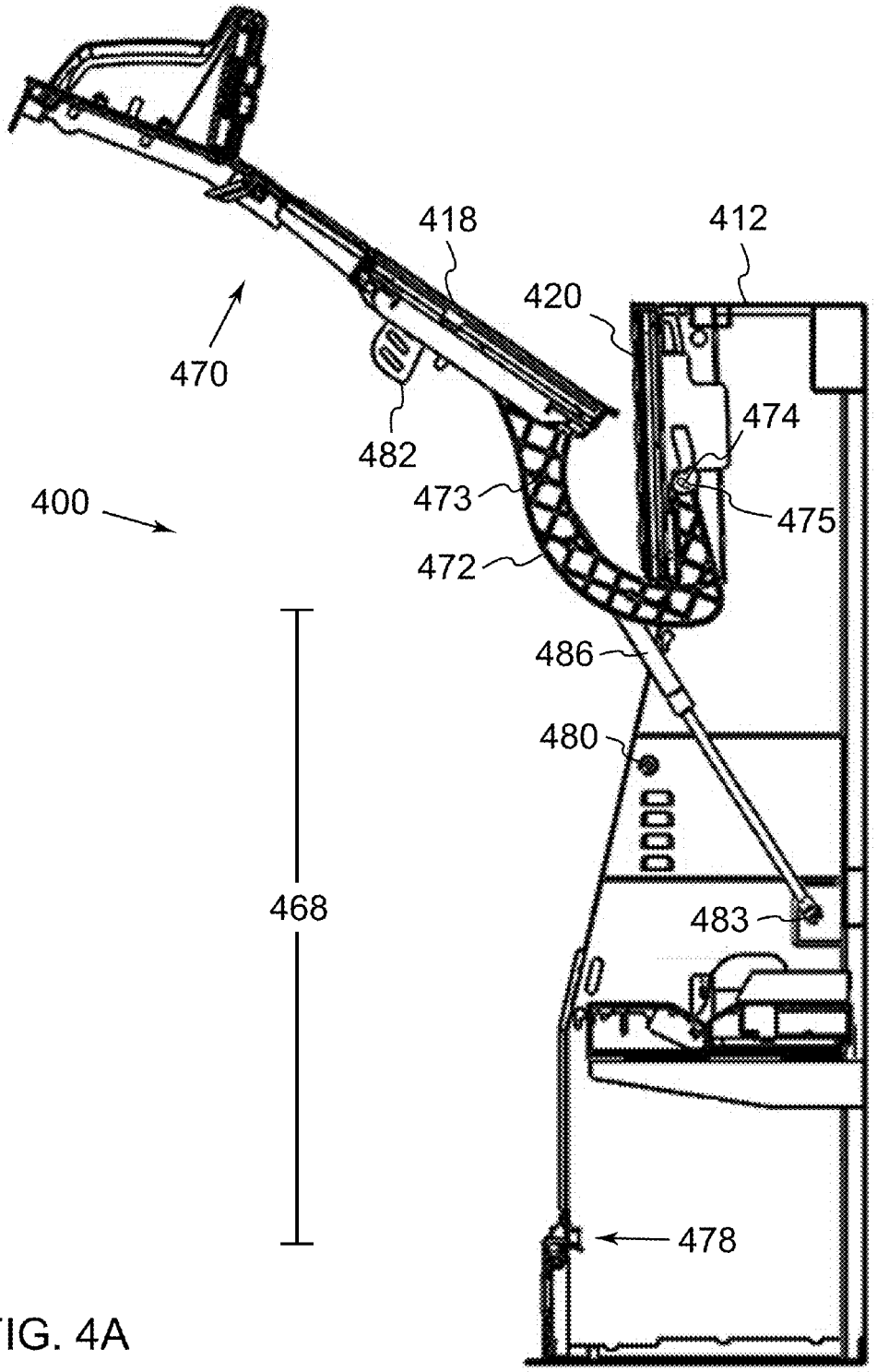
FIG. 4A is an image of an exemplary wagering game machine having a door in the full open position with closure components fully extended.

Referring now to FIG. 4A, a gaming machine 400 is shown in one embodiment of the invention. Gaming machine 400 comprises a cabinet housing 412 containing various components, including an upper display 420. The gaming machine 400 has a door opening 468 providing access to the internals of the gaming machine 400, including various gaming components such as those described in FIG. 2. A door 470 is configured to rotate between an open position (exposing the door opening 468) (shown) and a closed position (covering the door opening 468) (not shown). A lower display 418 is mounted to the door 470. The door 470 rotates about a floating-hinge mechanism (the combination of a hinge slot 474 and a hinge pin 475) to enable displacement of the door 470 and lower display 418 when the door 470 is in the closed position, and allow access to the internals of the gaming machine 400 when the door 470 is in the open position.

Only a single one of various components of gaming machine 400 are shown inside the housing 412 of FIG. 4A (for example, a single hinge arm 472, hinge pin 475, door roller 480, roller guide 482, closure component 486, etc.), but there may be multiples of one or more of these components in various embodiments. An embodiment that uses a single floating-hinge mechanism may have the floating-hinge mechanism and associated components centrally located within the housing 412 of the gaming machine 400. A set of duplicate components that function identically to a single floating-hinge mechanism are envisioned in one embodiment. For example, the hinge arms 472 may include a pair of hinge arms 472 (i.e., right and left hinge arms 472) symmetrically positioned on the left and right sections of the cabinet housing 412, respectively.

In this embodiment, the door 470 is connected to a pair of hinge arms 472 coupled to the cabinet 412. Each hinge arm 472 has a corresponding hinge pin slot 474 fixed to the housing 412 engaging a respective hinge pin 475 such that the door 470 rotates between the open and closed positions about the hinge pins 475. The hinge pins 475 are positioned coaxially along a common hinge axis defining the rotational movement of the hinge arms 472 and the door 470. One or more latching mechanisms 478 are situated in the housing 412 to maintain horizontal positioning of the door 470 in the closed position.

A set of door rollers 480 are also connected to the housing 412 that correspond to a set of roller guides 482 fixed to the door. The roller guides 482 are positioned to engage the respective door rollers 480 when the door is proximate to the closed position. The door rollers 480 rotate about respective roller axes that are substantially parallel to the hinge axis defined by the hinge pins 475. The door rollers 480 may have a variety of internal configurations, including ball bearings, radial ball bearings (shown), or another type of low friction rotating, sliding, or turning mechanism that allows the door roller 480 component to remain positionally fixed while guiding movement of the roller guides 482 and door 470 without significant friction.

A set of closure components 486 are connected to the hinge arms 472 of the door 470 at pivot 473 and connected to the housing 412 at pivot 483. The coupling of the closure components 486 at these pivot points may be achieved by a pin or other mechanism that allows the ends of the closure components 486 to rotate about the fixed coupling points (e.g., hinge pins 475).

The closure components 486 and door rollers 480 are configured and positioned to bias the door to translate the hinge arms 472 and door 470 toward the hinge pin 475, and ultimately determine the position of the door 470 in the closed position. When the door 470 is in the closed position, each roller guide 482 contacts a respective door roller 480 and the closure components 486 are positioned such that a minimal rotational force is applied to the door 470 in this neutral position. A minimal rotational force is defined such that the door 470 and hinge arms 472 having substantially and effectively no torque about the hinge pin 475. That is, there is no applied force on the door 470 in the closed position that would cause the door 470 to rotate about the hinge pins 475. However, the closure components 486 do apply a force to the door 470 and hinge arms 472 when in the closed position, substantially in the direction of the hinge pins 475, causing the door 470 to translate along the hinge slot 474 when the door 470 is proximal to and in the closed position. That is, when the door 470 is in the closed position, the closure components 486 apply force to translate the door 470 toward the rotational axis (hinge axis) of the hinge pins 475, and little (if any) rotational torque is experienced by the door 470 around the hinge pins 475. Additionally, as the closure components 486 provide (translational) force in the direction of the hinge pins 475, the translation of the door 470 is physically halted by the roller guides 482 (directly affixed to the door 470) contacting the door rollers 480 (directly affixed to the housing 412).

The orientation of the door and components as shown should not limit the scope and spirit of the invention. For example, while the door 470 is shown opening against gravity, a side-mounted door 470 is also possible. The door 470 shown in FIG. 4A is in the open position being positionally higher (elevated) compared to the door 470 in the closed position. Alternatively, the door 470 could open laterally, where the vertical position (elevation) of the door 470 is the same in both the open and closed position. In an embodiment where the door 470 is opened vertically (e.g., FIG. 4A), the closure component 486 may support the door 470 in both the open and closed position. That is, the closure components 486 hold the door 470 static when in the open position as well as the closed position (compensating against gravity and the weight of the door) until an external force is applied, such as a person rotating the door 470 by pulling or pushing. If the door 470 is mounted to open laterally, the closure components 486 may statically hold the door 470 in place in a similar way, but no compensation against gravity would be required. Instead, the closure components 486 may hold the door 470 statically such that tilting or shifting of the cabinet 412 does not cause the door 470 to move without significant external force. This may be desirable for placement on a non-level or shifting surface, for example, on a moving ship. Thus, no matter the orientation of the door 470, the closure components 486 are configured to hold the door 470 statically positioned, resisting rotation of the door 470 from the open position and the closed position in the absence of external forces.

Further, components may not be completely symmetric in the cabinet housing 412, and may be positioned in accordance with specific design constraints or spacing requirements dependent upon the various internal components installed in housing 412.

Figure 4B:
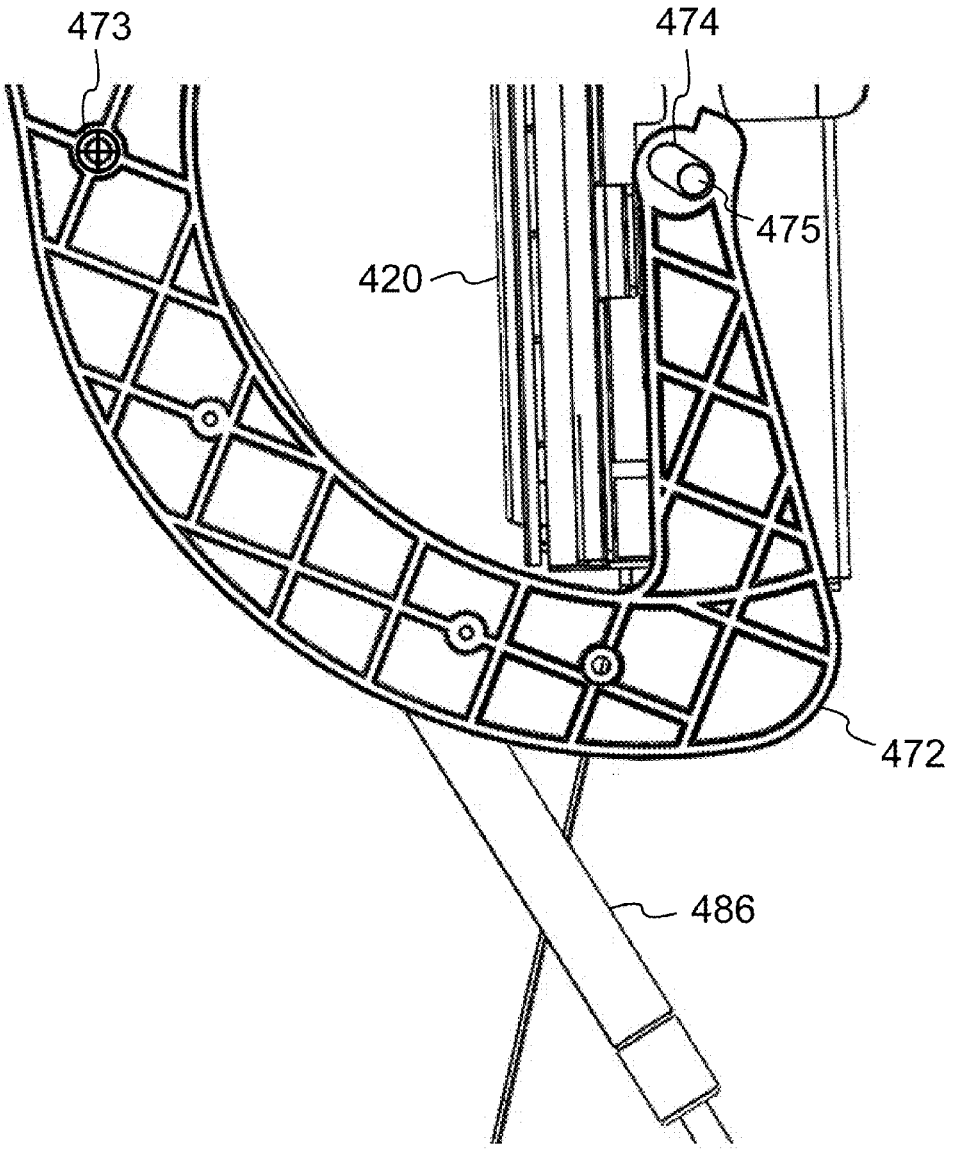
FIG. 4B is a close up view highlighting the hinge arm, hinge pin, and hinge slot of the wagering game machine of FIG. 4A.

Referring also to FIG. 4B, each hinge arm 472 has a corresponding hinge pin slot 474 engaging a respective hinge pin 475. This enables the door 470 to rotate between the open and closed positions about the hinge pins 475 when sufficient forces are applied to the door 470. The orientation and direction of the hinge slots 474 and the closure components 486 are specifically chosen to control all the applied forces and the translation of the hinge arms 472 while the door 470 is in various positions. The pivot 473 and pivot 483 may be located to fine-tune the distribution of applied forces and the resulting translation of the hinge arms 472 as the door 470 progresses through various phases of movement.

The closure components 486 may be mechanical springs, gas spring supports, or a combination, in addition to other types of resistant mechanisms. In one embodiment, while the door 470 is in the open position, the closure components 486 are configured to support the full weight of the door 470. The combination of the closure component 486, the door 470, and the hinge arm 472 rotating about the pivot 473, biases the door 470 to displace along the hinge slot 474 until the hinge pin 475 stops the hinge arm 472 from displacing further. Thus, when the door 470 is in the open position, the hinge pin 475 is positioned at one end of the hinge slot 474.

Figure 5A:
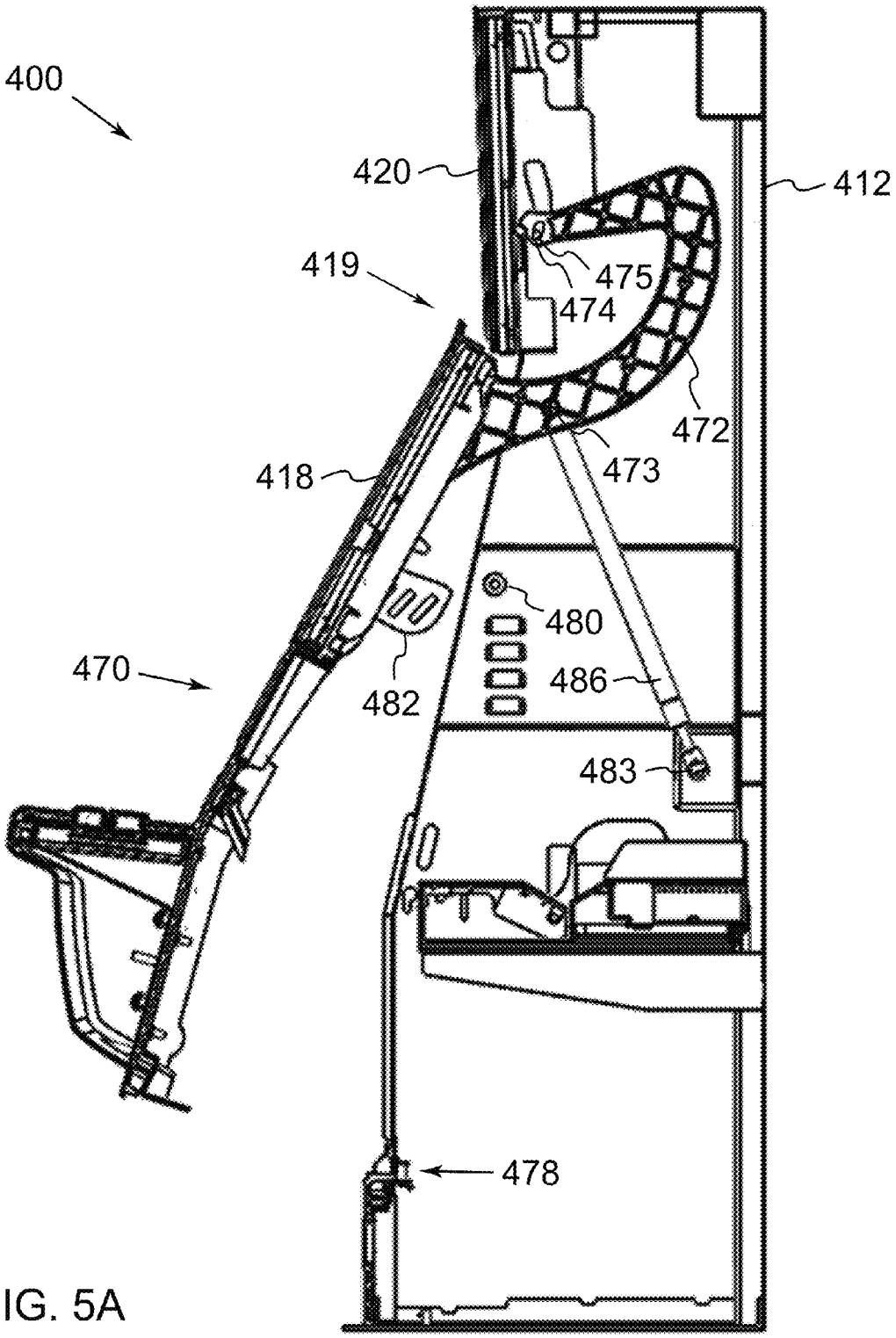
FIG. 5A is an image of an exemplary wagering game machine having a door proximate to the closed position.
Figure 5B:
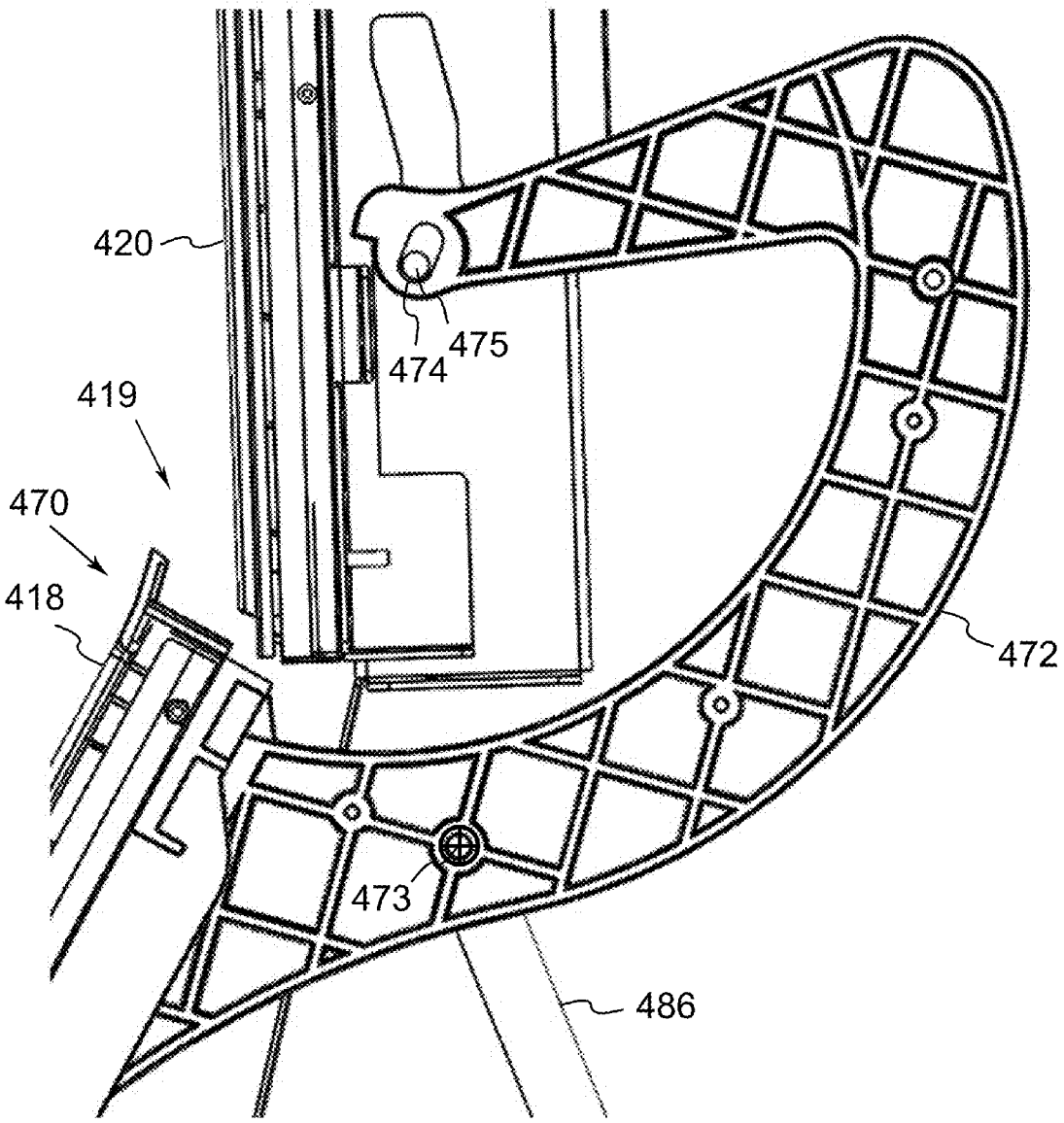
FIG. 5B is a close up view highlighting the hinge arm, hinge pin, and hinge slot of the wagering game machine of FIG. 5A.
Figure 7A:
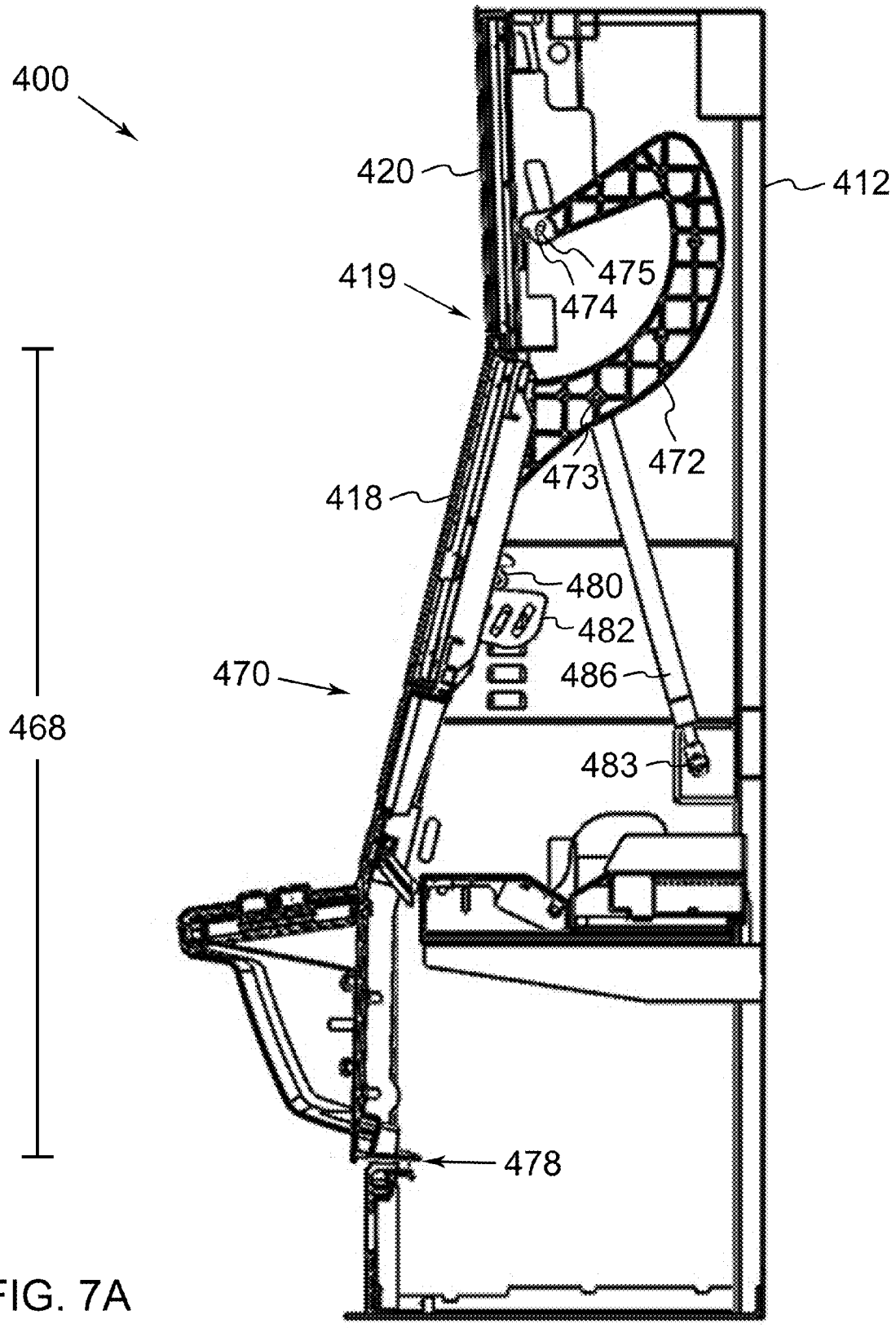
FIG. 7A is an image of an exemplary wagering game machine having a door in the closed position.

Referring now to FIGS. 5A-5B, the door 470 is shown approaching the closed position (FIG. 7A). When the door 470 becomes proximate to the closed position, the force of the closure components 486 translates the hinge arms 472 and door 470 up along the path defined by the hinge slot 474. It is noted that when comparing the hinge slot 474 and hinge pin 475 displayed in FIG. 4B, the hinge pin 475 of FIG. 5B is now positioned at the opposite end of the hinge slot 474 due to this translation. Thus, as the door 470 is proximate to the closed position as shown in FIG. 5A-5B, the closure components 486 cause the door 470 and the hinge arms 472 to translate along the hinge slot 474 toward the hinge pin 475.

When the door 470 is in a medial position, the size of the seam gap 419 decreases as the door 470 approaches the closed position. As the door 470 approaches the closed position, a seam gap 419 may become evident in the positioning between the lower display 418 and the upper display 420. When the door 470 is placed in the closed position, a pronounced seam gap 419 may remain as a result of an aggregation of manufacturing tolerances, and often results in an unsightly lack of conformity in the final assembly.

The seam gap 419 when the door 470 is in the closed position of an assembled cabinet 412 is often unpredictable during the manufacture of the various components, and may result from one or more components deviating from a specified size of manufacture. Process tolerances, actual feature size, used materials, desired surface finishes, production timing constraints, and various quality control measurements and assessments are a reality of the manufacturing process and all of these contribute to variances in produced components. Even though the dimensions of individual components used to assemble the gaming machines 400 may meet or exceed a given (acceptable) margin of error (tolerance), as more inaccuracies occur, manufacturing anomalies and inaccuracies are evident. In many cases, the designing of machinery enables the cascading of many marginal errors (all within a specific set of measurable tolerances) among multiple components to aggregate to the positioning of a single compound component, like the door 470, resulting in a pronounced seam gap 419 that is unacceptable. Thus, using the door rollers 480 to specifically dictate the ending position of the door roller guides 482, statically affixed to the door 470, enables precise control over the positioning of the door 470 and minimization of the seam gap 419 even when the size of the initial seam gap 419 is completely unpredictable during manufacture of components and the final assembly of the wagering game machine 400.

Figure 6A:
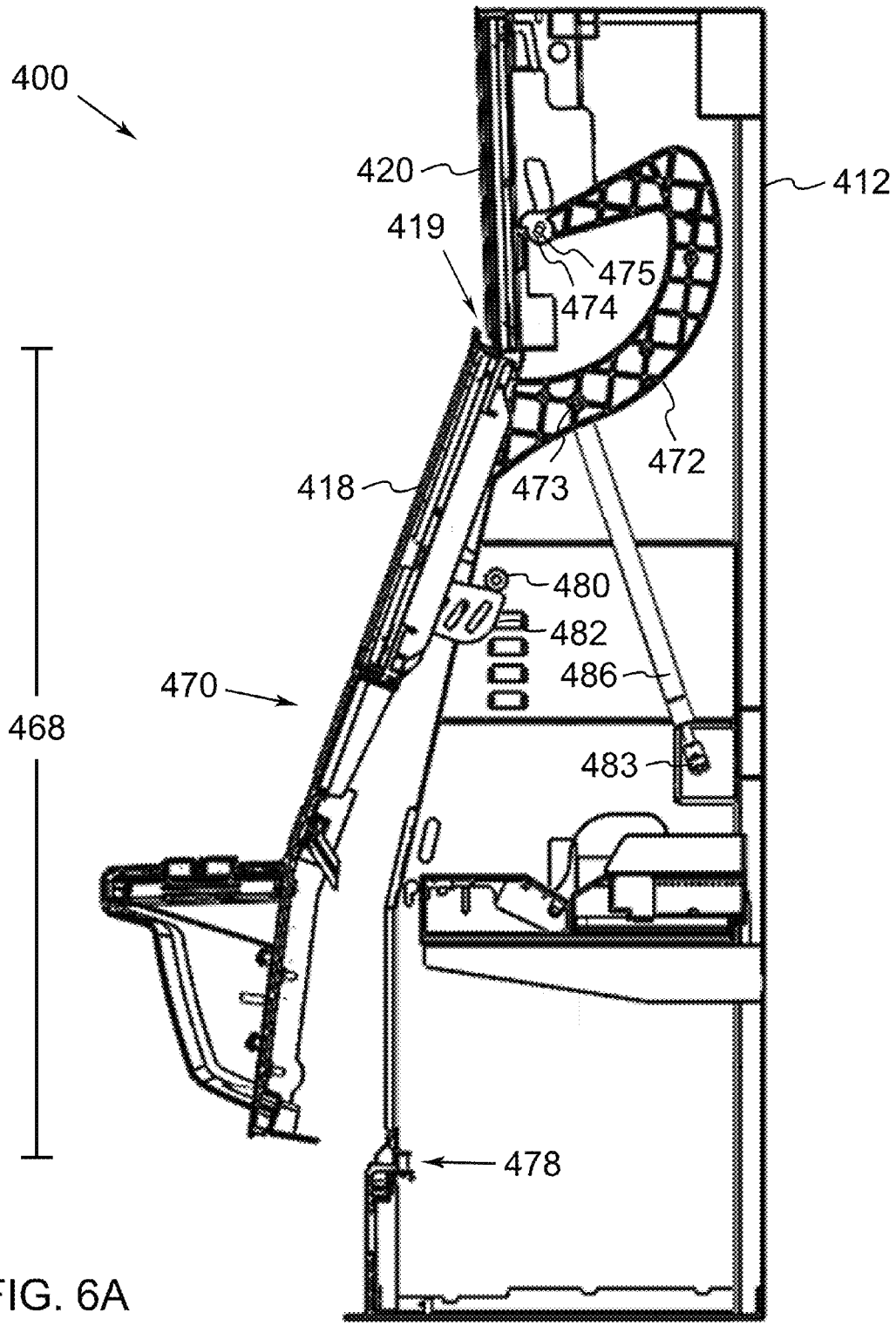
FIG. 6A is an image of an exemplary wagering game machine having a door proximate to the closed position, having contact between the door roller and door roller guide.
Figure 6B:
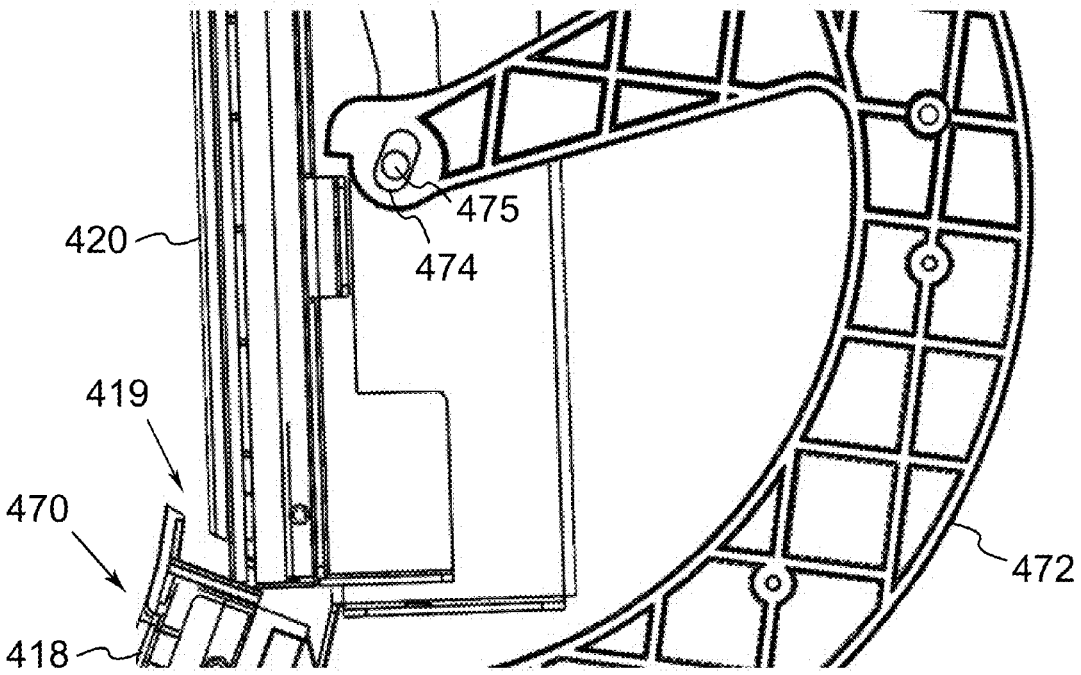
FIG. 6B is a close up view highlighting the hinge arm, hinge pin, and hinge slot of the wagering game machine of FIG. 6A.
Figure 6C:
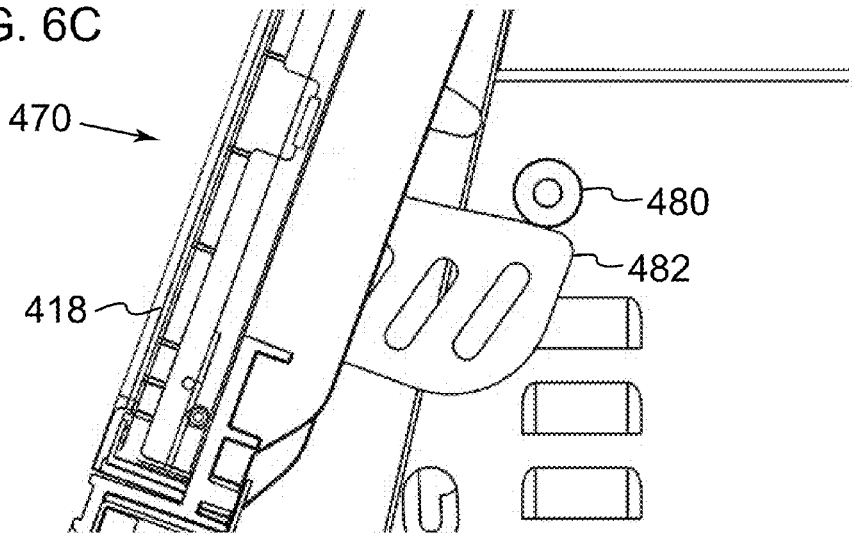
FIG. 6C is a close up view highlighting the door roller and door roller guide of the wagering game machine of FIG. 6A.

Referring now to FIGS. 6A-6C, as the door further approaches the closed position, the door roller guides 482 come into contact with the door rollers 480 that are rigidly affixed to the cabinet 412. As the closure component 486 applies forces to the hinge arm 472 and door 470 (displacing the door 472 in the direction of the hinge pin 474 as discussed above), each roller guide 482 comes into contact with its respective door roller 480, translating the door 470 and hinge arms 472 along the hinge slot 474 away from the hinge pin 475. Thus, the contact of the door roller 480 with the door roller guide 482 causes the hinge arm 472 to translate such that the hinge slot 474 floats on the hinge pin 475 when the door 470 approaches the closed position (e.g., FIG. 6B). In this way, the position of the door rollers 480 (and corresponding roller guides 482) may be used to specify placement of the door 470 in the closed position by controlling vertical movement of the door 470 in a precise fashion. The precise control of the positioning of the door 470 in the closed position using the door rollers 480 allows an assembler to maintain a proper (and aesthetically pleasing) seam gap 419 spacing between the lower display 418 and the upper display 420 in light of a multitude of dimensional variations introduced by manufacturing errors. In one embodiment, the hinge pin 474 may be resultantly positioned close to the center of the hinge slot when the door is in the closed position, but may be positioned anywhere within the hinge slot 475 depending upon required positioning of the door 470, manufacturing tolerance of the hinge slot 474, and/or position of the hinge slot 474 in the hinge arm 472.

When the door 470 is in the opened position, the closure components 486 apply an upward force to the hinge arms 472 to inhibit the door 470 from rotating down without additional applied force. An operator pulling on the door 470 in the open position simply needs to consistently overcome the force of the closure components 486 to rotate the door 470 toward the closed position. As the door 470 is proximate to the closed position, the closure components 486 apply force to the hinge arms 472 translating the hinge arms 472 and door 470 upward, substantially in the direction of the hinge slots 474; the closure components 486 are applying forces such that the door 470 translates along the path of the hinge slots 474. This approximately vertical displacement of door 470 may be used to minimize and precisely control the size of the seam gap 419 between the lower display 418 and the upper display 420. The roller guides 482 are specifically positioned to stop further displacement of the door 470 toward the hinge pins 475 by engaging the rigidly affixed door rollers 480 and translating the door 470 along the hinge slot 474. Thus, when the door 470 is in the closed position, there is a combination of the closure components 486 applying a force to the hinge arms 472 and the door 470 while the affixed door roller guides 482 engage the door rollers 480 to cause vertical displacement of the door 470 along the hinge slot 474. This enables precise positioning of the door 470 (and the statically positioned lower display 418) in the closed position. The location of the door rollers 480 and door roller guides 482 with respect to the hinge slot may be utilized to limit or specify the location of the door 470 in the closed position and precisely control the size of the seam gap 419.

Thus, the vertical positioning of the door 470 is ultimately determined by the placement of the door rollers 480 (in relation to the other components). The door 470, through use of the floating-hinge mechanism having the hinge slot 474 and the hinge pin 475, is precisely controllable in the vertical direction by placement of the mating door rollers 480 and door roller guides 482. The horizontal (i.e., front-back) position of the door 470 is determined by the placement of the hinge pins 475 and the latching mechanism(s) 478 at the base of the door 470, engaging the door 470 in the closed position. Thus, the position of the door 470 in the closed position, even when faced with a compounding build up and aggregation of manufacturing tolerances, may be controlled and eliminated to minimize the seam gap 419 and other positional challenges during assembly.

Figure 7B:
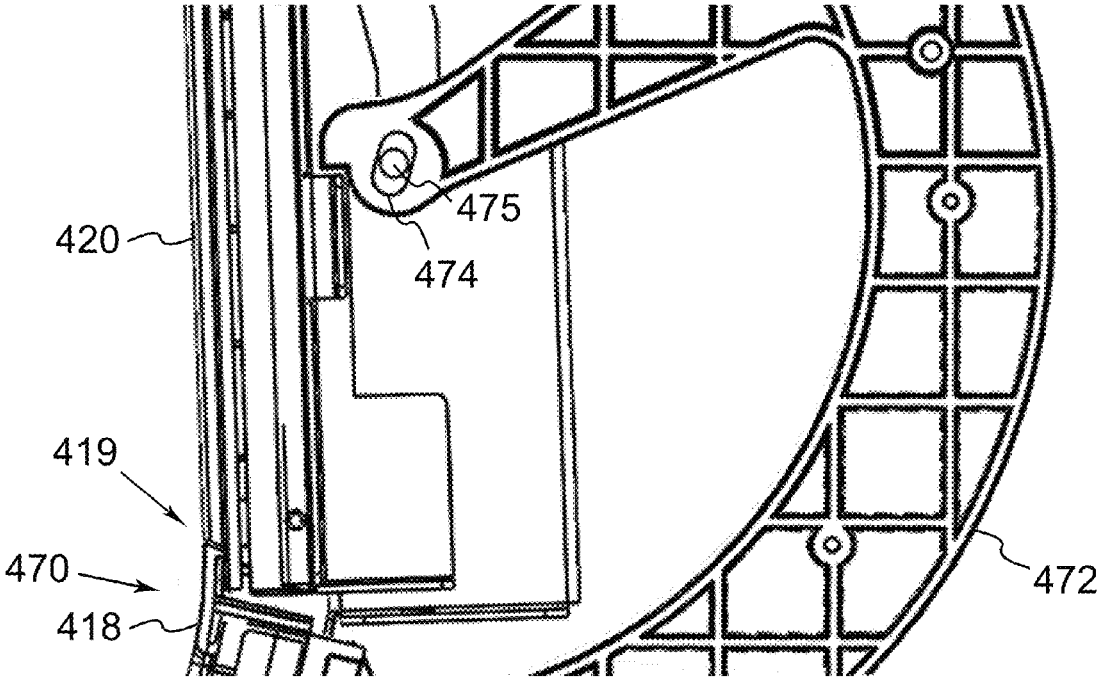
FIG. 7B is a close up view highlighting the hinge arm, hinge pin, and hinge slot of the wagering game machine of FIG. 7A.
Figure 7C:
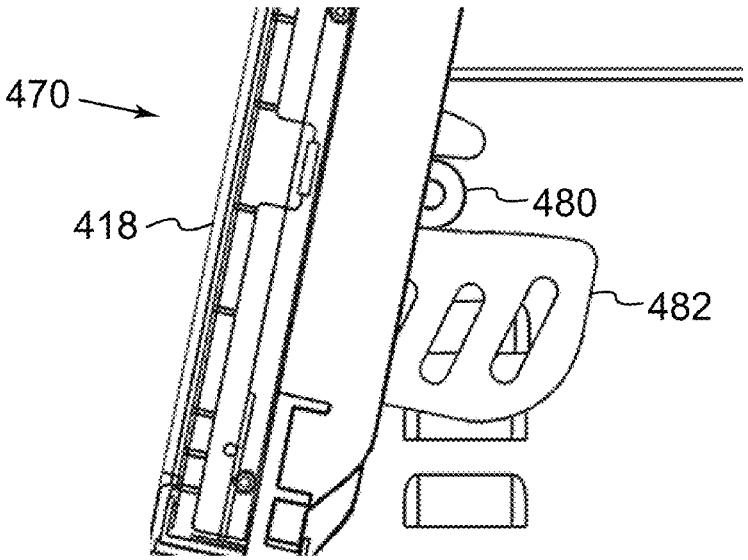
FIG. 7C is a close up view highlighting the door roller and door roller guide of the wagering game machine of FIG. 7A.

Referring now to FIGS. 7A-7C, the door 470 is shown in the closed position. The latching mechanism 478 at the base of the door 470 is shown closed, engaging (and locking) the bottom of the door 470 into placed while the door 470 remains in the closed position. The door rollers 480 are fully engaged with the door roller guides 482, helping to position the door 470 in a particular vertical position of the cabinet 412. The closure components 486 apply constant force to the hinge arms 472 toward the hinge pins 475 such that a minimized (if any) rotational force is applied to the door 470 in this neutral position. The hinge slot 474 of the hinge arm 472 floats on the hinge pin 475 due to the combination of force applied to the hinge arm 472 from the closure component 486 translating the door 470 toward the hinge pin 475, and the force applied to the door roller guide 482 from the door roller 480 translating the door 470 away from the hinge pin 475 (e.g., FIG. 7B).

When the door 470 is in the closed position, the hinge pin 475 may end up positioned anywhere in the hinge slot 474, but generally, the relative location of the hinge pin 475 will be close to the center of the hinge slot 474 (not touching either end of the hinge slot 474). In an embodiment utilizing a pair of hinge arms 472, a pair of hinge slots 474, and a pair of hinge pins 475, each of the hinge pins 475 is positioned approximately central the corresponding hinge slot 474 (i.e., not touching either edge of the hinge slot 474) when the door is in the closed position.

The floating nature of the hinge slot 474 and the hinge pin 475 allows precision refinement of the resting closed position of the door 470 by enabling translation of the door 470 in both directions of the hinge slot 474, as required, to minimize the seam gap 419. Using the door rollers 480 and door roller guides 482 to precisely control and minimize the seam gap 419 caused by manufacturing errors of various components of the gaming machine 400 reduces adjustment of the door 470 using very few components. In short, the floating nature of the hinge slot 474, resulting from forces from the closure components 486 and placement of the door rollers 480 mating with the door roller guides 482, enables precise control of the door 470 for minimizing the seam gap 419 when the door 470 is in the closed position. This control is maintained over a wide span of various components, each having distinct manufacturing tolerances during production, aggregated error-build up, and wear and tear, stressing, and flexing of components over the course of many uses. The fixed hinge pin 475 and hinge slots 474 provide a way to shift the door 470 in the closed position by guiding the hinge arms 472 without stressing components of the assembled system. The precisely determined position of the door 470 is achieved by the combination of forces applied to the hinge arms 472 and the position of the door rollers 480, thereby allowing the hinge slots 474 of the door 470 to float on the fixed hinge pin 475 and achieve precise placement and a minimized seam gap 419.

In another embodiment, the positioning of the hinge slots 474 and hinge pins 475 may be oppositely configured. That is, the hinge slots 474 may be part of the housing 412, rather than an integral part of the hinge arms 472 as displayed. In this embodiment, the corresponding hinge pins would be statically affixed to (or preferably integrally a part of) the hinge arms 472.

In another embodiment, the door 470 has only a single set of components (i.e., a single hinge arm 472, hinge slot 474, hinge pin 475, door roller 480, door roller guide 482, closure component 486, etc.) that are substantially centrally located on the door 470 and/or within the cabinet 412. The door 470 and corresponding door assembly, including positioning, hinging, and latching mechanisms, maintain the same functions as detailed above where two or more are employed. Likewise, more than two of the components may also be employed in a single gaming terminal cabinet to provide even greater stability, positional accuracy, and structural integrity. All of these embodiments are envisioned as being extensions of the teachings provided herein.

In one embodiment, a door 470 coupled to a game housing 412 of a gaming machine 400 is configured to realize a method of minimizing force and wear on one or more of the hinge pins 475. The door opening 468 allows access to the internal components of the gaming machine 400 when the door 470 is in an open position. In the closed position, the door 470 covers the door opening 468 and prohibits access to the internal components of the gaming machine 400. The door 470 is part of a door assembly further including at least one hinge arm 472, at least one associated closure component 486, and a door-positioning connector (e.g., door roller guide 482). The door-positioning connector mates with a corresponding housing door-positioning connector (e.g., door roller 480) fixed to the housing 412. The hinge arm 472 has a first end and a second end, the first end being fixed to the door 470 and the second end being movably connected to the housing 412 by a hinge pin 475 engaged in a hinge slot 474. The closure component 486 is pivotally connected to the hinge arm 472 between the first and second end. The closure component 486 applies an upward force to the hinge arm 472 and the door-positioning connector resists the upward force and fixes the door position in the closed position when mated with the housing door-positioning connector fixed to the housing.

The method for minimizing force and wear on one or more of the hinge pins 475 is achieved by supporting the door 470 in the open position by the upward force of the closure component 486 and restraining the door 470 and assembly from rotating the moveable connection to the closure component 486 about the hinge pin 475 by translating the door 470 and closure component 486 such that the hinge pin 475 is seated at one end of the hinge slot 474. The door 470 and door assembly is supported in the closed position by the upward force of the closure component 486.

In one embodiment, when the door 470 and door assembly is supported in the closed position, the hinge pin 475 is medially positioned in the hinge slot 474. As the door 470 moves from the closed position to a full open position (or the full open position to the closed position), the hinge pin 475 traverses the hinge slot 474. The hinge pin 475 is positioned medial the hinge slot 474 (i.e., not in contact with either end) when the door is in the closed position.

The door 470 and door assembly are precisely positioned with respect to the housing by the mated door-positioning connectors 480, 482 acting to minimize forces applied to the hinge pin and restrain the door 470 in the closed position from moving upward. The seam gap 419 between the top of the door 470 and the housing 412 is minimized by positioning the mated door-positioning connectors 480, 482 setting the vertical position of the door in the closed position. The placement of the closure component 486 and the mated door-positioning connectors 480, 482 reduce or completely eliminate rotational force applied to the hinge arm 472 by the closure component 486 by pivotally connecting the closure components 486 to the housing 412 such that there is effectively no rotational force about the hinge pin 475 applied to the door 470 and the hinge arm 472 by the closure component 486. In one embodiment, the closure component 486 is pivotally connected to the housing 412 of the gaming terminal 400.

In one embodiment, the door 470 is latched to the housing 412 when in the closed position using a latching assembly 478 such that the position of the hinge pin 475, the mated door-positioning connectors 480, 482, and the latching assembly 478 set the position of the door 470 relative to the housing 412 when the door 470 is in the closed position.

Thus, each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming terminal primarily dedicated to playing a casino wagering game, the gaming terminal comprising:

a housing for enclosing gaming components;

a door opening in the housing for accessing the gaming components inside the game housing;

a door connected to the housing, the door having an open position that exposes the door opening, and a closed position that covers the door opening;

a pair of hinge arms, each hinge arm having a first end and a second end, the first end being fixed to the door and the second end being movably connected to the housing by a hinge pin engaging a hinge slot in the hinge arm enabling the hinge arm to both translate and rotate about the hinge pin, the hinge pin being connected to one of the second end of the hinge arm and the housing, the hinge slot being part of the other of the second end of the hinge arm and the housing;

a pair of closure components, each pivotally connected to one of the pair of hinge arms between the first end and the second end, each closure component applying an upwards force on the corresponding hinge arm as the door translates between the open and the closed position, the closure components supporting the hinge arms while the door in the open position is cantilevered from the opposite ends of the hinge arms by restraining the hinge pins against one end of the hinge slots; and a pair of mating door guides and door stops, each door guide being fixed to one of the door and the housing, and each door stop being fixed to the other of the door and the housing, the pair of mating door guides and door stops restraining the door while the door in the closed position is supported by the closure components.

2. The gaming terminal of claim 1, wherein the position of the pair of door stops determines the vertical position of the door in the closed position to minimize a seam gap between the top of the door and the housing.

3. The gaming terminal of claim 1, wherein the closure components are also pivotally connected to the housing such that there is effectively no rotational force about the hinge pins applied to the door and the hinge arms by the closure components.

4. The gaming terminal of claim 1, wherein the pair of hinge arms, the pair of hinge slots, the pair of hinge pins, the pair of closure components, the pair of door guides, and the pair of door stops are positioned symmetrically in respect to the housing of the gaming terminal.

5. The gaming terminal of claim 1, further comprising a latching assembly for latching the door to the housing when in the closed position such that positioning of the hinge pins, the pair of door stops, and the latching assembly determine the position of the door relative to the housing when the door is in the closed position.

6. The gaming terminal of claim 1, wherein the pair of closure components are pivotally connected to the housing of the gaming terminal.

7. The gaming terminal of claim 1, wherein each of the pair of hinge pms is positioned approximately central the corresponding hinge slot when the door is in the closed position.

8. A gaming cabinet comprising:

a housing for enclosing gaming components, the housing including a door opening for accessing the gaming components; and a door assembly having an open position that exposes the door opening and a closed position that covers the door opening, the door assembly comprising:

a door;

a hinge arm having a first end and a second end, the first end being fixed to the door and the second end being movably connected to the housing by a hinge pin that engages a hinge slot, the hinge pin being connected to one of the second end and the housing, the hinge slot being part of the other of the second end and the housing;

a closure component pivotally connected to the hinge arm between the first and second end, the closure component applying an upward force to the hinge arm toward the hinge pin while the door assembly moves between the open and closed positions; and mating door-positioning connectors including a door guide and a door stop fixing the door position in the closed position, the door guide being fixed to one of the door assembly and the housing, the door stop being fixed to the other one of the door assembly and the housing, the door-positioning connectors engaging when the door assembly is proximate the closed position and resisting the upward force when the door assembly is in the closed position;

wherein the door assembly in the open position is supported by the upward force and restrained by the hinge pin being seated at one end of the hinge slot, and the door assembly in the closed position is supported by the upward force and restrained by the door guide engaging the door stop, the hinge pin being medial the one end and the opposite end of the hinge slot when the door assembly is in the closed position.

9. The gaming terminal of claim 8, wherein the position of the door stop determines a vertical position of the door in the closed position to minimize a seam gap between a top of the door and the housing.

10. The gaming terminal of claim 8, wherein the closure component is also pivotally connected to the housing such that there is effectively no rotational force about the hinge pin applied to the door and the hinge arm by the closure component.

11. The gaming terminal of claim 8, further comprising a latching assembly for latching the door to the housing when in the closed position such that the positions of the hinge pin, the door stop, and the latching assembly set the position of the door relative to the housing when the door is in the closed position.

12. The gaming terminal of claim 8, wherein the closure component is pivotally connected to the housing of the gaming terminal.

13. The gaming terminal of claim 8, wherein the hinge pin traverses the full length of the hinge slot when the door moves from the closed position to a full open position or the full open position to the closed position, and is positioned approximately central the hinge slot when the door is in the closed position.

14. A gaming machine, comprising:

a housing for enclosing gaming components, the housing including a door opening for accessing the gaming components; and a door assembly having an open position that exposes the door opening and a closed position that covers the door opening, the door assembly comprising:

a door;

a pair of hinge arms, each hinge arm having a first end and a second end, the first end being fixed to the door and the second end being movably connected to the housing by a hinge pin engaging a hinge slot enabling the hinge arm to both translate and rotate about the hinge pin, the hinge pin being connected to the housing, the hinge slot being part of the second end of the hinge arm; and a pair of closure components, each pivotally connected to one of the pair of hinge arms between the first end and the second end, each closure component applying a translational force on the corresponding hinge arm toward the corresponding hinge pin while the door moves between the open and the closed position;

a pair of mating door-positioning connectors, each pair of mating door-positioning connectors including a door guide and a door stop fixing the door position in the closed position, the door guide being fixed to the door assembly, the door stop being fixed to the housing, the mating door-positioning connectors engaging when the door assembly is proximate the closed position and resisting the translational force when the door assembly is in the closed position;

wherein the door assembly in the open position is held static by the translational force and restrained by the hinge pins being seated at one end of the hinge slots, and the door assembly in the closed position is held static by the translational force and restrained by the door guides engaging the door stops, the hinge pins being positioned medial the one end and an opposite end of the hinge slots when the door assembly is in the closed position.

15. The gaming terminal of claim 14, wherein the pair of hinge pins, the pair of hinge arms, the pair of door guides, the pair of door stops, and the pair of closure components are arranged on the right side and the left side of the gaming terminal symmetrically along a horizontal axis.

16. The gaming terminal of claim 15, wherein the pair of hinge pins, the pair of hinge arms, the pair of door guides, the pair of door stops, and the pair of closure components are arranged such that the door is at a higher elevation in the open position than in the closed position.

17. The gaming terminal of claim 14, wherein the pair of hinge pins and the pair of hinge arms are positioned on one of the right side or the left side of the housing, and the pair of door guides and the pair of door stops are positioned on the other of the right side or the left side.

18. The gaming terminal of claim 17, wherein the pair of hinge pins, the pair of hinge arms, the pair of door guides, the pair of door stops, and the pair of closure components are arranged such that the door is at the same elevation in the open position and the closed position.

19. The gaming terminal of claim 14, further comprising a latching assembly configured to latch the door to the housing when the door is in the closed position, wherein the position of the pair of hinge pins, the pair of door stops, and the latching assembly set the position of the door relative to the housing when the door is in the closed position.

20. The gaming terminal of claim 14, wherein each of the pair of hinge pins is positioned approximately central the corresponding hinge slot when the door is in the closed position.

* * * * *